US005288961A

United States Patent [19]

Shibuya et al.

[11] Patent Number: 5,288,961

[45] Date of Patent: Feb. 22, 1994

[54] HIGH FREQUENCY HEATING APPARATUS UTILIZING AN INVERTER POWER SUPPLY

[75] Inventors: Makoto Shibuya, Yamatokoriyama; Naoyoshi Maehara; Daisuke Bessyo, both of Nara; Yuji Nakabayashi, Yamatokoriyama; Takahiro Matsumoto, Ikoma; Shiro Takeshita, Nara, all of Japan

[73] Assignee: Matsushita Electric Industrial Co., Ltd., Osaka, Japan

[21] Appl. No.: 858,525

[22] Filed: Mar. 27, 1992

[30] Foreign Application Priority Data

| | | | |
|---|---|---|---|
| Apr. 5, 1991 | [JP] | Japan | 3-072733 |
| Apr. 5, 1991 | [JP] | Japan | 3-72857 |
| Jun. 5, 1991 | [JP] | Japan | 3-134007 |
| Jul. 31, 1991 | [JP] | Japan | 3-191798 |
| Oct. 4, 1991 | [JP] | Japan | 3-257498 |

[51] Int. Cl.[5] ..... H05B 6/80

[52] U.S. Cl. ..... 219/690; 219/400; 219/702; 126/198; 361/695

[58] Field of Search ..... 219/10.55 R, 10.55 B, 219/10.55 F, 10.55 M, 10.55 D, 400; 99/325; 126/21 A, 21 R, 198; 165/135, 59; 361/383, 384

[56] References Cited

U.S. PATENT DOCUMENTS

| | | | |
|---|---|---|---|
| 3,129,312 | 4/1964 | Ojelid | 219/10.55 R |
| 4,100,463 | 7/1978 | Sugie | 219/10.55 R |
| 4,131,779 | 12/1978 | Tatsukawa et al. | 219/10.55 R |
| 4,184,945 | 1/1980 | Morgan et al. | 219/10.55 R |
| 4,296,297 | 10/1981 | Miller | 219/10.55 F |
| 4,314,126 | 2/1982 | Yoshimura et al. | 219/10.55 R |
| 4,332,993 | 6/1982 | Shibahara et al. | 219/10.55 R |
| 4,383,156 | 5/1983 | Furusawa | 219/10.55 B |
| 4,623,771 | 11/1986 | Sakino | 219/10.55 B |
| 4,661,669 | 4/1987 | Matsushima et al. | 219/10.55 R |
| 4,705,928 | 11/1987 | Nakanishi | 219/10.55 B |
| 4,812,617 | 3/1989 | Takeuji et al. | 219/10.55 R |
| 4,956,531 | 9/1990 | Braunisch et al. | 219/10.55 B |

FOREIGN PATENT DOCUMENTS 2925338 1/1980 Fed. Rep. of Germany .

*Primary Examiner*—Bruce A. Reynolds
*Assistant Examiner*—Tu Hoang
*Attorney, Agent, or Firm*—Spencer, Frank & Schneider

[57] ABSTRACT

A high frequency heating arrangement includes a power converting unit with one or more semiconductor devices which dissipates a slight heat loss. A magnetron receives an output from the power converting unit and supplies electromagnetic waves to a heating chamber. The magnetron dissipates a heat loss that is relatively larger than that of the power converting unit. A cooling fan has a motor which dissipates a heat loss which is relatively smaller than that of the power converting unit. The cooling fan is for cooling the power converting unit and the magnetron. A case is provided in which at least the power converting unit and the magnetron are housed and which is made of an electricity-conductive material. A cooling air passage, along which the motor and the case are arranged, and through which air flows from said cooling fan is provided. Air sent from the cooling fan first cools the motor, then cools at least a portion of the power converting unit, and finally cools the magnetron.

13 Claims, 8 Drawing Sheets

HIGH FREQUENCY HEATING APPARATUS UTILIZING AN INVERTER POWER SUPPLY

BACKGROUND OF THE INVENTION

1. Field of the Invention

The present invention relates to a high frequency heating apparatus which uses microwaves, for heating food or a dielectric of, e.g. a catalyst, and more particularly to a high frequency heating apparatus which utilizes an inverter power supply for driving a magnetron which generates microwaves.

2. Description of the Related Art

The construction of a related high frequency heating apparatus is described with reference to the circuit diagram thereof shown in FIG. 8. In the figure, power from a commercial power supply 1 is converted into direct current by a rectifier 2. The DC voltage is applied through a filter circuit 3 to a resonance circuit composed of a capacitor 4 and an inductor 5 and a series circuit composed of a semiconductor switching device 6 and a diode 6A. The semiconductor switching device 6 oscillates at a frequency of several tens kHz or more to generate high frequency alternating current, working together with the resonance circuit. The voltage of the alternating current generated in the inductor 5 is raised by a transformer 7, whose primary winding is the inductor 5. The high voltage provided by the transformer 7 is converted into a DC high voltage by a high-voltage rectifier 8. A control circuit 9 signals to drive the semiconductor switching device 6. These electric component parts thus compose an inverter power supply (a power converter) 10. The DC high voltage provided by the high-voltage rectifier 8 is applied between the anode and cathode of a magnetron 11. The transformer 7 is provided with an extra winding 12 which supplies power to the cathode of the magnetron 11. When the cathode is heated by the power supplied thereto and the high voltage is applied between the cathode and anode, the magnetron 11 oscillates to generate microwaves. The microwaves thus generated are used to irradiate an object, such as food, placed in a heating chamber.

Since the inverter power supply 10 processes high power such as 1 to 2 kW, the electric component parts thereof cause a substantial loss and which is dissipated as heat. Therefore, the electric component parts must be cooled. For example, the inverter power supply 10 is provided with forced-air cooling means composed of a motor 13 and a fan 14, which flows air to cool the electric component parts. The rectifier 2 and the semiconductor switching device 6 are provided with aluminium fins to facilitate heat radiation.

FIG. 9 illustrates a high frequency heating apparatus body 15 to which an inverter power supply 10, a magnetron 11, a motor 13 and a fan 14 are separately mounted. As understood from the illustration, the air stream must cover a substantially large area in order to sufficiently air-cool the inverter power supply 10 and the magnetron 11. Therefore, a propeller fan is employed as the cooling fan 14, which can generate a large air flow. An AC motor is employed as the motor 13 to drive the cooling fan 14. Thus, the forced air cooling is performed by a combination of an AC motor and a propeller fan. Such an air cooling system becomes inevitably large.

Such a conventional high frequency heating apparatus has problems as described below.

First, since the inverter power supply 10, the motor 13, etc., are separately mounted to the high frequency heating apparatus body 15, many assembly processes are required. Lead wires must be used to connect components such as the inverter power supply 10, the motor 13 and the like to the power source in order to supply required powers to the components respectively. During assembly, after the inverter power supply 10 and the motor 13 are mounted to the high frequency heating apparatus body 15, they are connected to the power source by the lead wires. Since there is only a small space for the lead wires to be wired, the wiring process is not easy and normally requires manual labor. Also, since the inverter power supply 10, the motor 13, etc., vary in shape and each of them must be wired with lead wires, the assembly processes are hard to automate and simplify.

Second, the lead wires supplying power to the inverter power supply 10, the motor 13, the magnetron 11, etc., radiate undesirable electromagnetic waves which affect electrical appliances, such as a TV or a radio, placed nearby.

Third, since the semiconductor switching device 6 produces a lot of heat and requires substantially large fins for efficient heat radiation, the large fins take up a large amount of space on the printed board, and thus hinder employing a small and compact printed board.

In addition, U.S. Pat. No. 4,956,531 discloses a power module in which an inverter power supply is placed in a metallic envelope and a magnetron and a fan are compactly combined. In the above power module, the three components are separately placed in different casings. Therefore, the three casings must be connected to one another during the assembly of the high frequency heating apparatus. Further, the casing of the magnetron and the casing of the inverter power supply must be connected to the power source by means of lead wires. This wiring process is troublesome Also, the lead wires used for the connection are likely to radiate undesirable electromagnetic waves (noises).

SUMMARY OF THE INVENTION

The present invention is constructed in order to solve the above-stated problems.

It is a first object of the present invention to provide a high frequency heating apparatus whose power supply system (a magnetron, an inverter power supply and a cooling fan) is made compact and small.

It is a second object of the present invention to simplify the assembly work of a high frequency heating apparatus and reduce the number of assembly steps in order to substantially reduce production costs.

It is a third object of the present invention to provide a high frequency heating apparatus which substantially reduces undesirable electromagnetic radiation so as to give little disturbance to the electromagnetic environment and achieve high reliability.

It is a fourth object of the present invention to provide a high frequency heating apparatus which prevents output electromagnetic waves from leaking from the wave guide.

It is a fifth object of the present invention to provide a power supply system of a high frequency heating apparatus which has an increased cooling efficiency.

To achieve the first object of the present invention, a high frequency heating apparatus comprises: a power converting unit comprising one or more semiconductor devices; a magnetron which receives the output from the power converting unit and supplies electromagnetic waves to a heating chamber; and a cooling fan for cooling the power converting unit and the magnetron. At least the power converting unit and the magnetron are housed in a case which is made of an electricity-conductive material. The air sent from the cooling fan cools at least a portion of the power converting unit before it cools the magnetron. Also, a portion or the whole of the fan case of the cooling fan is formed of a cooling member, and a component part of the power converting unit is mounted on the cooling member so as to facilitate cooling of the component part.

Further, a transformer and a semiconductor switching device which are electric component parts of the power converting unit are arranged upstream of a passage of the cooling air stream generated by the cooling fan. The magnetron is placed downstream thereof. Such arrangement facilitates reducing the size of the power supply system. In such arrangement, the magnetron and the electric component parts of the power converting unit can be placed close to one another. Thus, packaging density can be increased. Also, the passage of cooling air does not need to be large, and it is not required that the fan generates a large flow of air. Thus, the size of the apparatus can be reduced.

To achieve the second object, a high frequency heating apparatus according to the present invention comprises: a power converting unit comprising one or more semiconductor devices; a magnetron which receives the output from the power converting unit and supplies electromagnetic waves to a heating chamber; and a cooling fan for cooling the power converting unit and the magnetron. At least the power converting unit and the magnetron are housed in a case which is made of an electricity-conductive material. The component parts of the power converting unit are mounted on a printed board. At least a fan case of the cooling fan is mounted on the printed board. Also, a motor for driving the cooling fan is mounted on the printed board.

If a plurality of component parts of the power converting unit, the fan and the magnetron are housed in the electricity-conductive case, the assembly work of the high frequency heating apparatus is simplified. The plurality of component parts can be connected to the high frequency heating apparatus by simply mounting the case thereto. Also, the case can be formed in a desired shape so as to facilitate automated assembly. Further, lead wires are not required in order to connect the component parts with the power source since the power converting unit, the fan case and the motor of the cooling fan are mounted connected to the same printed board. Thus, the number of the assembly steps can substantially be reduced, and so can be production costs.

To achieve the third object, a high frequency heating apparatus according to the present invention comprises: a power converting unit comprising one or more semiconductor devices; a magnetron which receives the output from the power converting unit and supplies electromagnetic waves to a heating chamber; and a cooling fan for cooling the power converting unit and the magnetron. At least the power converting unit and the magnetron are housed in a case which is made of an electricity-conductive material.

In the above construction, the electricity-conductive case contains the magnetron, the power converting unit, the cooling fan, lead wires for supplying the output of the power converting unit to the magnetron and to the cooling fan. Such construction prevents noise radiation from leaking out of the high frequency heating apparatus.

To achieve the fourth object, a high frequency heating apparatus according to the present invention comprises: a power converting unit comprising one or more semiconductor devices; a magnetron which receives the output from the power converting unit and supplies electromagnetic waves to a heating chamber; and a cooling fan for cooling the power converting unit and the magnetron. At least the power converting unit and the magnetron are housed in a case which is made of an electricity-conductive material. A waveguide is employed to supply electromagnetic waves outputted by the magnetron to the heating chamber, and it is also used to connect the case with the heating chamber. A buffer member is placed between the case and a housing.

In the above construction, since both the waveguide and the housing bear the weight of the case which contains the power supply system, the distortion occurring in the connecting portion between the case and the waveguide is substantially reduced. Thus, it is unlikely that the distortion will become so large as to produce a gap through which microwaves leak.

Also, the buffer member provided between the case and the housing helps increase the dimensional tolerance of the connecting portions between the case and the waveguide and between the case and the housing. Therefore, even if the housing or the heating chamber is distorted because of assembly deviation or vibrations during transportation, the buffer member absorbs the distortion and prevents it from spreading.

To achieve the fifth object of the present invention, a high frequency heating apparatus comprises: a power converting unit comprising one or more semiconductor devices; a magnetron which receives the output from the power converting unit and supplies electromagnetic waves to a heating chamber; and a cooling fan for cooling the power converting unit and the magnetron. At least the power converting unit and the magnetron are housed in a case which is made of an electricity-conductive material. The air sent from the cooling fan cools at least a portion of the power converting unit before it cools the magnetron.

In the above construction, the electric component parts are arranged in a passage of the cooling air, in the manner that a component part which generates less heat is placed further upstream of the passage or in the manner that a component part having a lower endurable temperature is placed further upstream. The losses of the main electric component parts of the power converting unit are as follows: the loss of a rectifier is about 15 W; the loss of an inductor about 8 W; the loss of a semiconductor switching device about 40 W; and the loss of a transformer about 15 W. On the other hand, the magnetron causes a loss of about 300 W. Thus, the magnetron, which is large in size as well as in loss, substantially heats the cooling air. If the magnetron is placed upstream, a large flow of cooling air is required in order to sufficiently cool not only the magnetron but also the electric component parts placed downstream, such as the semiconductor switching device, the transformer, etc. In other words, it is required that the motor of the fan be driven substantially fast. Thus, cooling efficiency becomes substantially low. Also, if an electric component part having a higher endurable temperature is placed downstream, an electric component part having a lower endurable temperature can be protected from being exposed to excessively heated air. Thus, the service time thereof is sustained. As described above, efficient cooling can be performed by arranging the electric component parts in a passage of the cooling air, in the manner that a component part which generates less heat is placed further upstream of the passage or in the manner that a component part having a lower endurable temperature is placed further upstream.

The fifth object is also achieved by providing a high frequency heating apparatus further comprising a first air guide for guiding air to be used for cooling and a second air guide for guiding air having been used for cooling into the heating chamber.

In the above construction, heated air around the case is not taken into the case. Thus, the cooling efficiency of the high frequency heating apparatus is upgraded. In addition, since the air which has received heat in the case is guided into the heating chamber, an object inside the heating chamber is heated with increased efficiency.

The further objects, features and advantages of the present invention will become apparent in the description of the preferred embodiments with reference to the attached drawings.

BRIEF DESCRIPTION OF THE DRAWINGS

In FIGS. 1 to 9, the same numerals are used to denote parts or components having the same functions.

DETAILED DESCRIPTION OF THE PREFERRED EMBODIMENT

The construction and functions of the circuit of a high frequency heating apparatus according to the present invention are basically the same as those in the related art, and thus will not be described.

Figure 1:
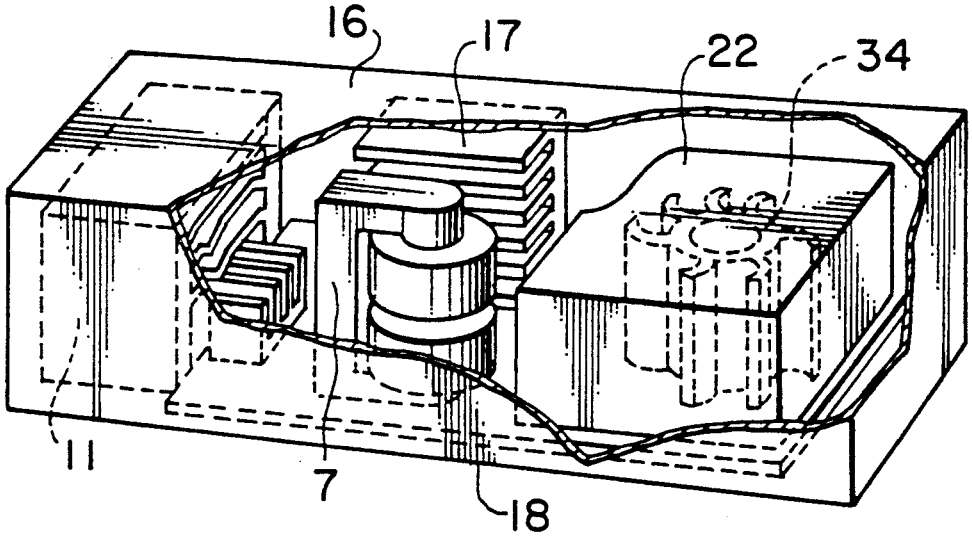
FIG. 1 is a perspective illustration of a power supply system of a high frequency heating apparatus according to one embodiment of the present invention.

FIG. 1 shows a power supply system in which the electric component parts are compactly assembled inside a case 16. A fan 34 is a sirocco type fan which is highly resistant against pressure damage. A motor 33 (not shown) for driving the fan 34 is a DC motor, which produces high speed rotation and contributes to downsizing.

The air stream generated by the fan 34 cools a component part of a control circuit which causes a loss of several watts. Then, it cools a transformer 7 and fins 17 attached to a semiconductor switching device (about 40 W loss) and a rectifier (about 15 W loss).

A magnetron 11 is placed farthest downstream of the passage of the cooling air since it causes a large loss, i.e. about 300 W. When the magnetron 11 is in normal operation, it is sufficient to cool the anode of the magnetron 11 down to about 1800° C. or lower. To obtain such a temperature of the anode, the magnetron 11 requires about 0.5 $m^3$/min of cooling air of a room temperature. If a fan 34 sends cooling air to the magnetron 11 at a rate of 0.5 $m^3$/min in the power supply system, the temperature of cooling air increases by about 10K before it reaches the magnetron 11 since the cooling air receives heat from the fins 17 and the transformer 7. In practice, therefore, the fan 34 is required to supply the magnetron 11 with cooling air at a rate of a little more than 0.5 $m^3$/min. In other words, it is required to increase the rotational speed of the motor.

Figure 2:
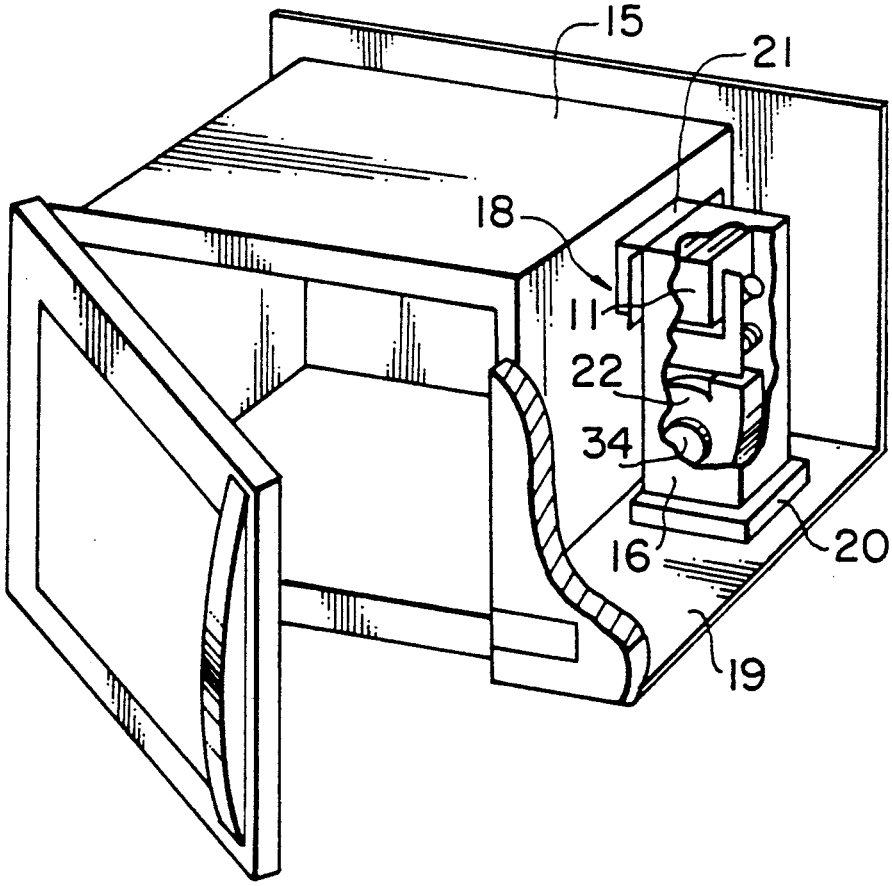
FIG. 2 is a perspective illustration of the power supply system shown in FIG. 1 when mounted to a housing of a high frequency heating apparatus according to the present invention.

As described above, the case 16 is made of aluminium and contains electric component parts compactly assembled. The electric component parts including the magnetron 11 are arranged in the cooling air passage in an increasing order of generated heat of endurable temperature. Such arrangement of the component parts enables efficient air-cooling and contributes to reducing the size of the power supply system. The power supply system can be made small enough to be easily mounted to a high frequency heating apparatus, as shown in FIG. 2. Also, as shown in FIG. 1, the case 16 shields noise sources: that is, the magnetron 11; the semiconductor switching device (not shown); the rectifier (not shown), the transformer 7; and the lead wires connecting the magnetron 11 with the transformer 7. Thus, noise radiation is substantially prevented. In other words, other electrical appliances will not be affected even if they are placed near the high frequency heating apparatus.

Figure 5:
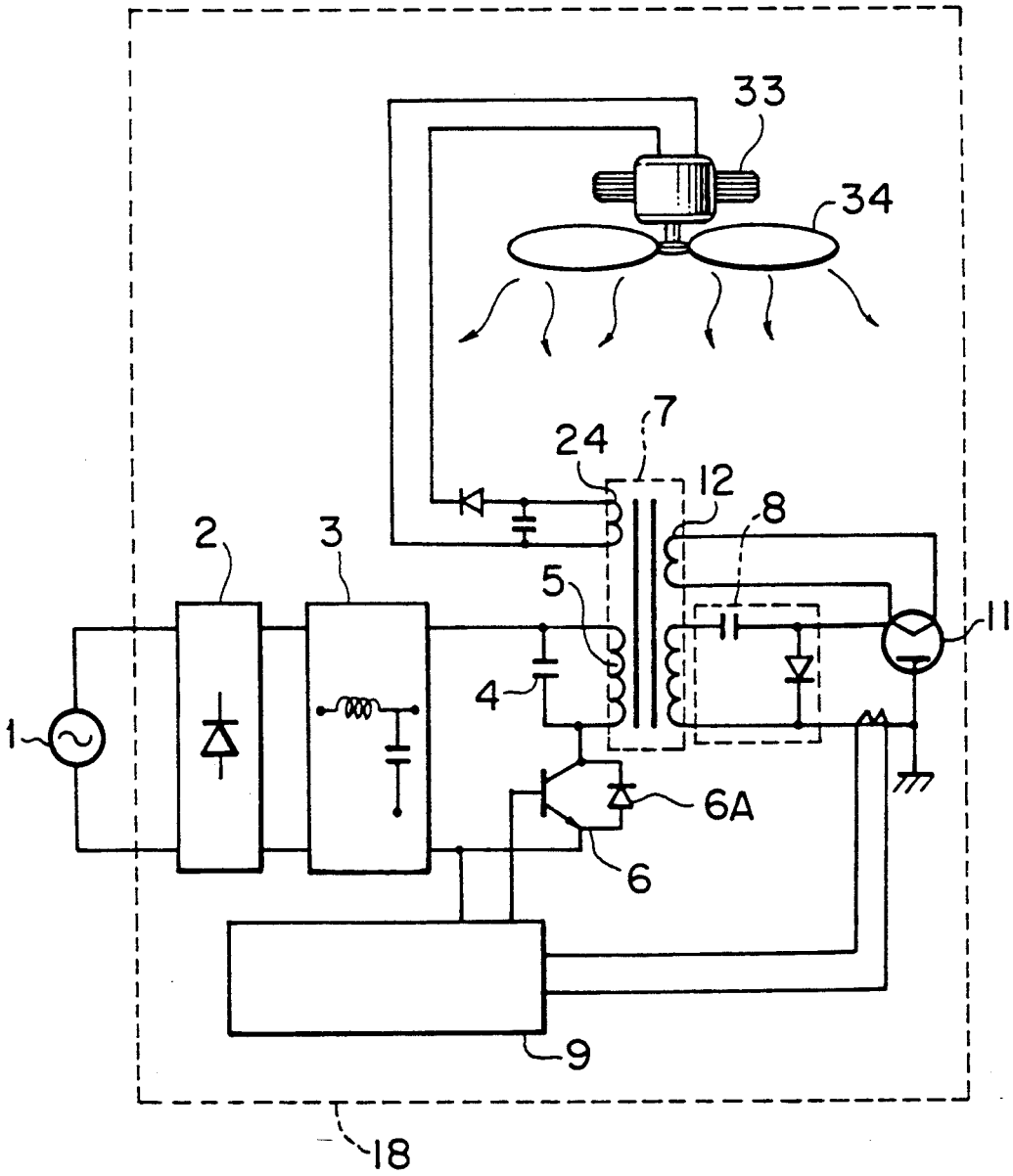
FIG. 5 is a circuit diagram of the power supply system shown in FIG. 1.

As understood from the illustration in FIG. 5, the electric component parts are housed in the case 16 so as to shield against the noise radiation from the above mentioned noise sources: that is, the magnetron 11; the semiconductor switching device 6; the rectifier 2; the transformer 7; and the lead wires connecting the magnetron 11 with the transformer 7, a cooling fan 34 is provided inside the case 16, and the electric component parts including the magnetron 11 are arranged in the cooling air passage in an increasing order of generated heat of endurable temperature. Such arrangement of the component parts enables efficient air-cooling and contributes to reducing the size of the power supply system 18. The power supply system 18 can be made small enough to be easily mounted to a high frequency heating apparatus 15.

FIG. 2 shows a high frequency heating apparatus 15 having an aluminium-made case 16 mounted thereto. The high frequency heating apparatus 15 according to this embodiment employs a buffer member 20 placed between the case 16 and the bottom board 19 of the apparatus. The buffer member 20 is made of an elastic material. The case 16 is mounted to the high frequency heating apparatus 15 by connecting the case 16 to a waveguide 21 as well as interposing the buffer member 20 between the case 16 and the bottom board 19.

In a related art which does not employ such a buffer member, the case 16 is connected to the apparatus only by means of the waveguide 21. As a result, all the weight of the case 16 is imposed on the portion of the waveguide 21. Thus, distortion is likely to occur in a connecting portion between the waveguide 21 and the case 16 and/or a connecting portion between the waveguide 21 and the apparatus body. If a substantially large distortion occurs in the connecting portions, it may produce a gap through which microwaves leak.

The above problem is solved by employing a buffer member as in this embodiment.

Also, the buffer member 20 prevents propagation of vibrations. Without the buffer member 20, the vibration of a cooling fan 34 contained in the case 16 causes resonance, and the vibration of the case 16 propagates to the bottom board 19 of the apparatus body. According to the present invention, the leakage of assembled printed board 23 in a solder bath once. The fan 34 is moved down to be mounted to a shaft of the motor 33, and the fan case cover 22 is also moved down for mounting. Thus, since only the vertical movements are required for the mounting of the electric component parts, the motor 33, the fan 34 and the fan case cover 22 to the printed board 23, the assembly can be easily automated.

Instead of an AC motor and a propeller fan employed in the conventional art, a DC motor and a sirocco fan are employed in this embodiment to reduce the size of the high frequency heating apparatus.

A sirocco fan normally provides a higher wind pressure than that of a propeller fan. Therefore, a sirocco fan is more suitable for cooling the printed board 23, in which the packaging density of the component parts is increased in order to reduce the size of the apparatus. In addition, the DC motor requires a low voltage DC power supply. Therefore, an extra winding 24 is provided in the transformer 7, which is one of the electric component parts of the inverter power supply 18. The low voltage AC power obtained from the winding 24 is rectified in order to provide a low voltage DC power.

In this embodiment, lead wires are not required since the transformer 7 and the motor 33 are mounted to the same printed board 23, whose pattern supplies power obtained from the transformer 7 to the motor 33. The conductive case 16 shields against the undesirable vibration and noise caused by the vibration to the outside of the apparatus are substantially reduced.

According to this embodiment, a plurality of the case 16 of the same construction can be mounted to a variety of models of high frequency heating apparatus, regardless of the construction of an apparatus or the shape of a heating chamber, simply by employing a waveguide 21 suitably made or shaped. Such a feature substantially helps reduce the number of steps which are required for changing the design of an apparatus or for developing the designs for a variety of models.

The waveguides 21 and the power supply systems 18 housed in the cases 16 can be separately manufactured and then connected on the assembly line. Therefore, a large number of the power supply systems 18 can be manufactured beforehand and stocked.

Figure 3:
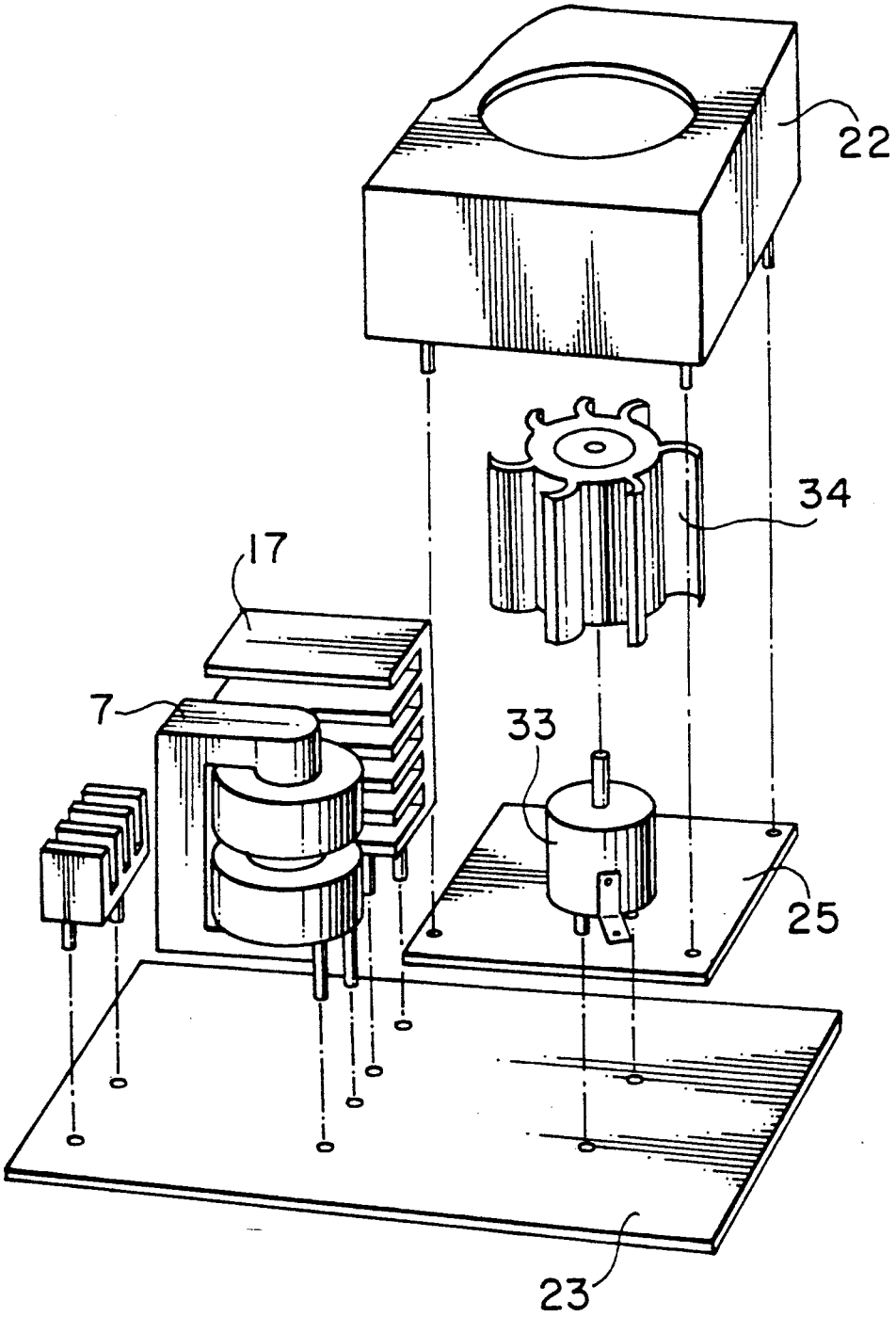
FIG. 3 is a partial perspective view of a cooling unit of the power supply system shown in FIG. 1.

FIG. 3 illustrates a method for mounting a fin member 17, a transformer 7, a fan 34 for cooling these electric component parts, a motor 33 for rotating the fan 34, and a fan cover 22, onto a printed board 23. The fin member 17 is connected to a semiconductor switching device, which is one of the electric component parts of an inverter power supply. As shown in the figure, the electric component parts, the motor 33, the fan 34 and the fan case cover 22 are mounted to the same surface (the top surface in FIG. 3) of the printed board. Thus, the electric component parts and the motor 33 can be soldered to the printed board 23 simply by dipping the electromagnetic waves radiated from the motor 33 and the electrical component parts such as the transformer 7, the semiconductor switching device 6, the cooling fin member 17, etc. Thus, a high frequency heating apparatus according to the present invention does not affect the other electrical appliances such as a TV, a radio,, etc.

Figure 4:
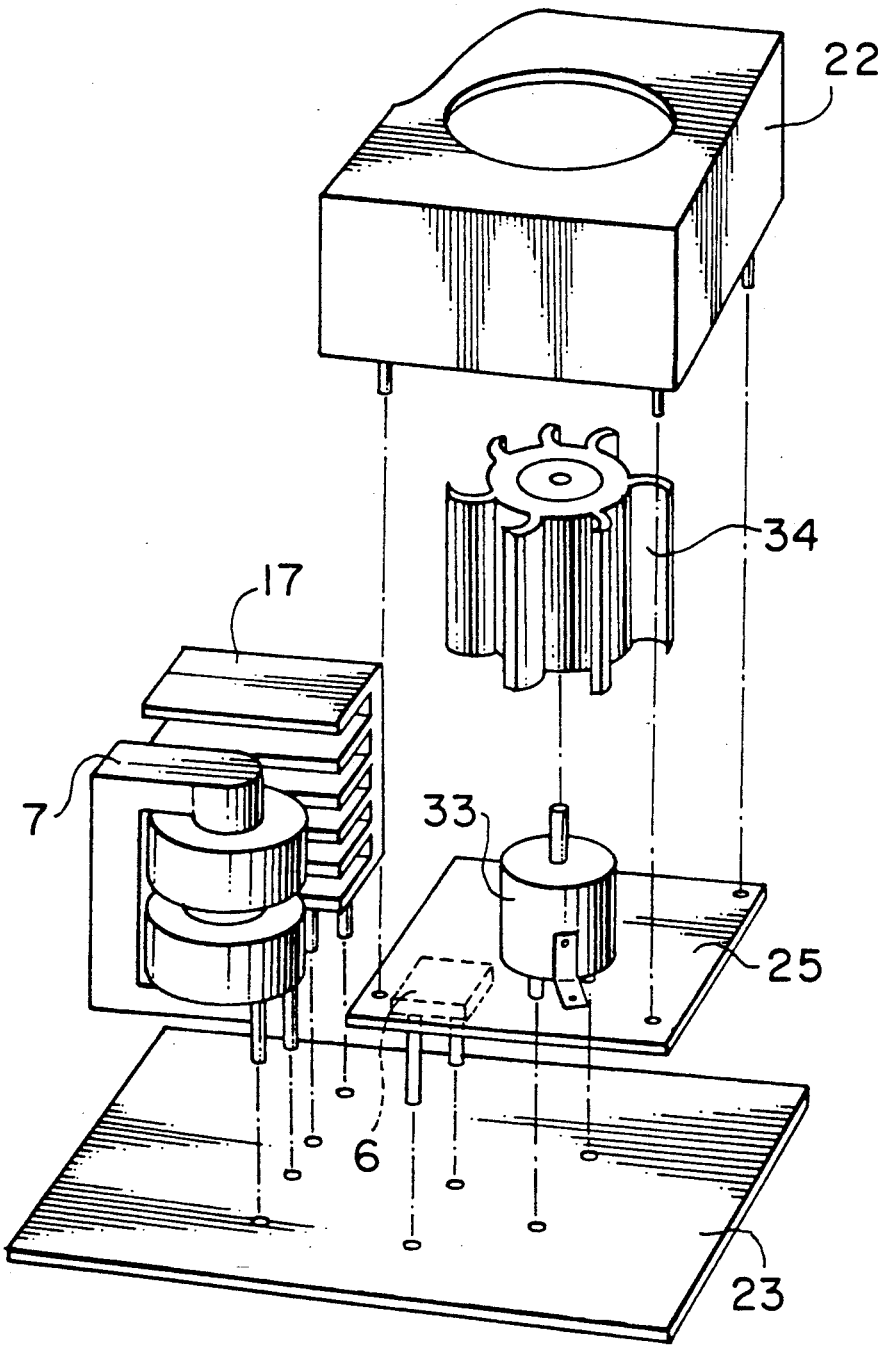
FIG. 4 is a perspective view of a cooling unit according to another embodiment of the present invention.

FIG. 4 illustrates another mounting method in which a semiconductor switching device 6 is mounted on a fan case 25. The fan case 25 includes a table for supporting a motor 33. A highly heat-conductive material such as aluminium is used to form the fan case 25 so that the heat generated by the semiconductor switching device 6 is effectively released through the fan case 25. Thus, the fan case 25 functions not only as a guide for the air stream generated by a fan 34 but also as a supporting table for the motor 33 and a cooling member for the semiconductor switching device 6. Since an upper portion of the fan case 25 is exposed to a substantially large air flow, heat is effectively released therefrom. Thus, the semiconductor switching device 6 can be effectively cooled. Working together with the fan case 25, a fan case cover 22 releases heat. Since a portion or the whole of the fan case 22 and the fan case cover 25 function as a cooling member, a separate cooling member for the semiconductor switching device 6 (such as the fin member 17 in FIG. 3) is not needed. Thus, space on the printed board can be more effectively utilized so that a closely-packed structure will be obtained.

According to the present invention, a cooling member for a heat-emitting component part such as a semiconductor switching device may be built into a fan case by employing a method other than the method described above with reference to FIG. 4.

Figure 6:
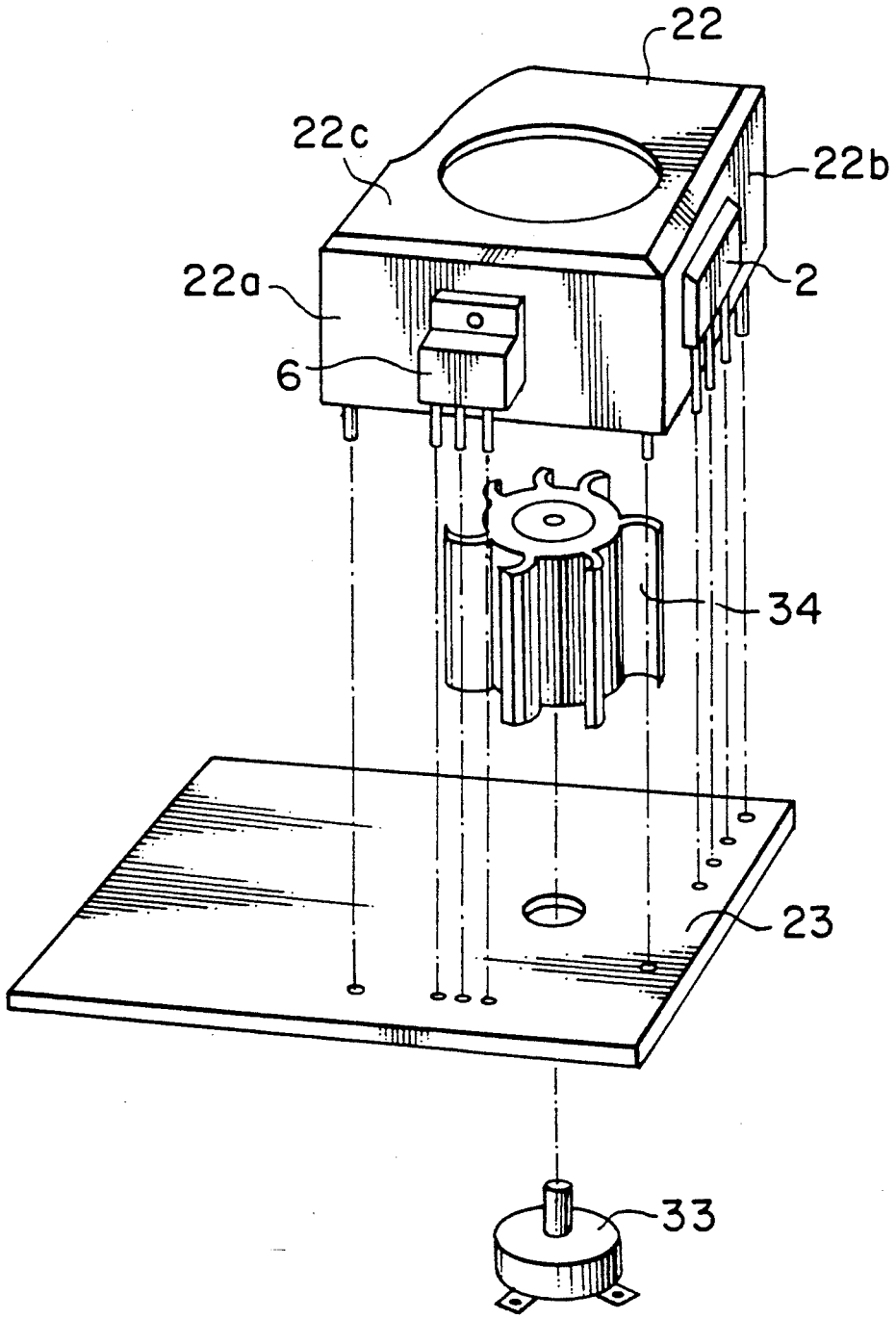
FIG. 6 is a partial perspective view of a cooling unit according to still another embodiment of the present invention.

For example, with reference to FIG. 6, a fan cover 22 is formed by employing cooling members made of, e.g. aluminium for two side walls **22*a* and 22*b* thereof and resin-made members for the rest portion 22*c* thereof. A semiconductor switching device 6 and a rectifier 2 are mounted respectively on the two side walls 22*a* and 22*b*. The assembled fan case cover 22 is mounted on a printed board 23, as shown in FIG. 6**.

Also, as shown in FIG. 6, only the fan case cover 22 may be mounted on the printed board 23, a motor 33 being separately mounted on a case (not shown). This construction is suitable for a case where the vibration of the motor 33 is so strong as to possibly cause damage to the printed board 23 or where the motor 33 is an AC motor driven by a commercial power supply 1 (not shown).

Figure 7:
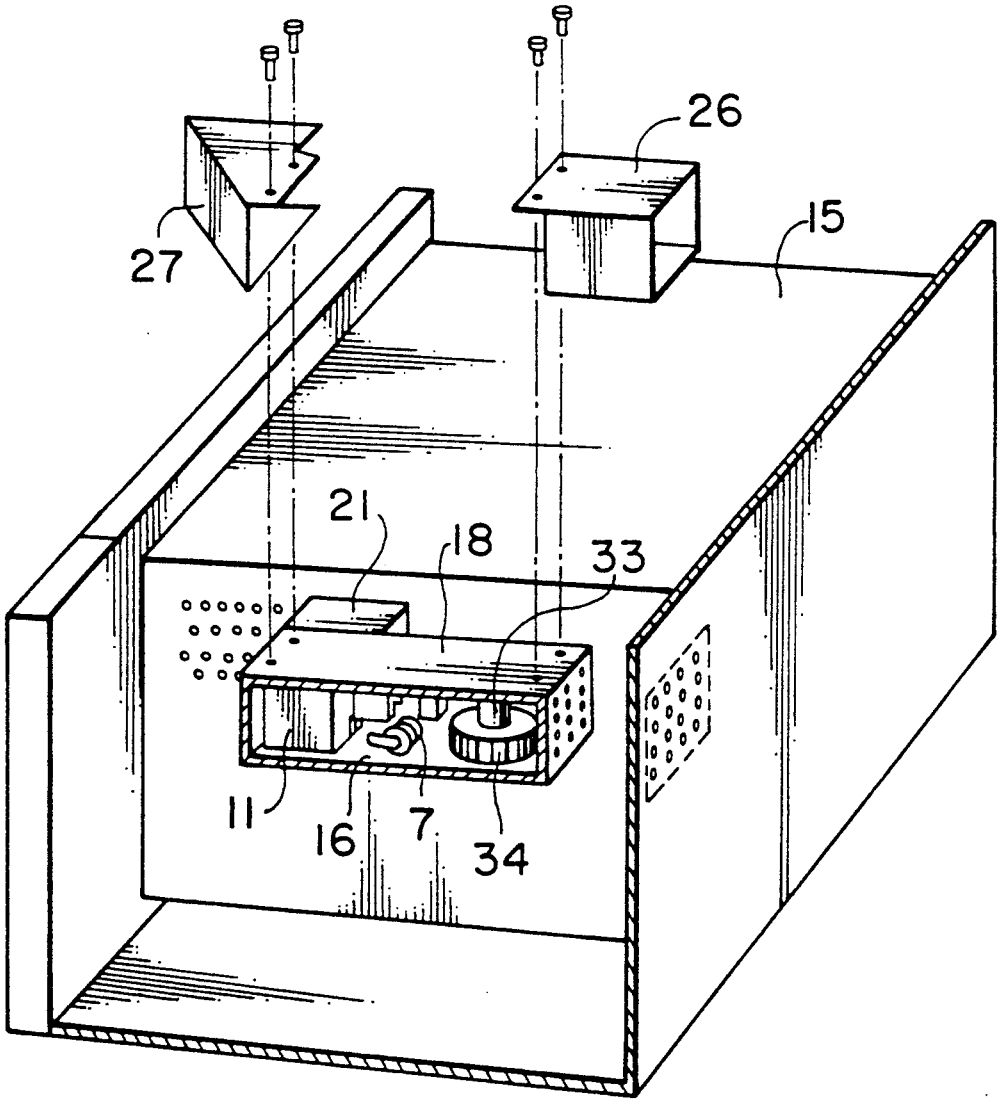
FIG. 7 is a perspective illustration of a power supply system according to another embodiment of the present invention, when mounted to the housing of a high frequency heating apparatus.
Figure 8:
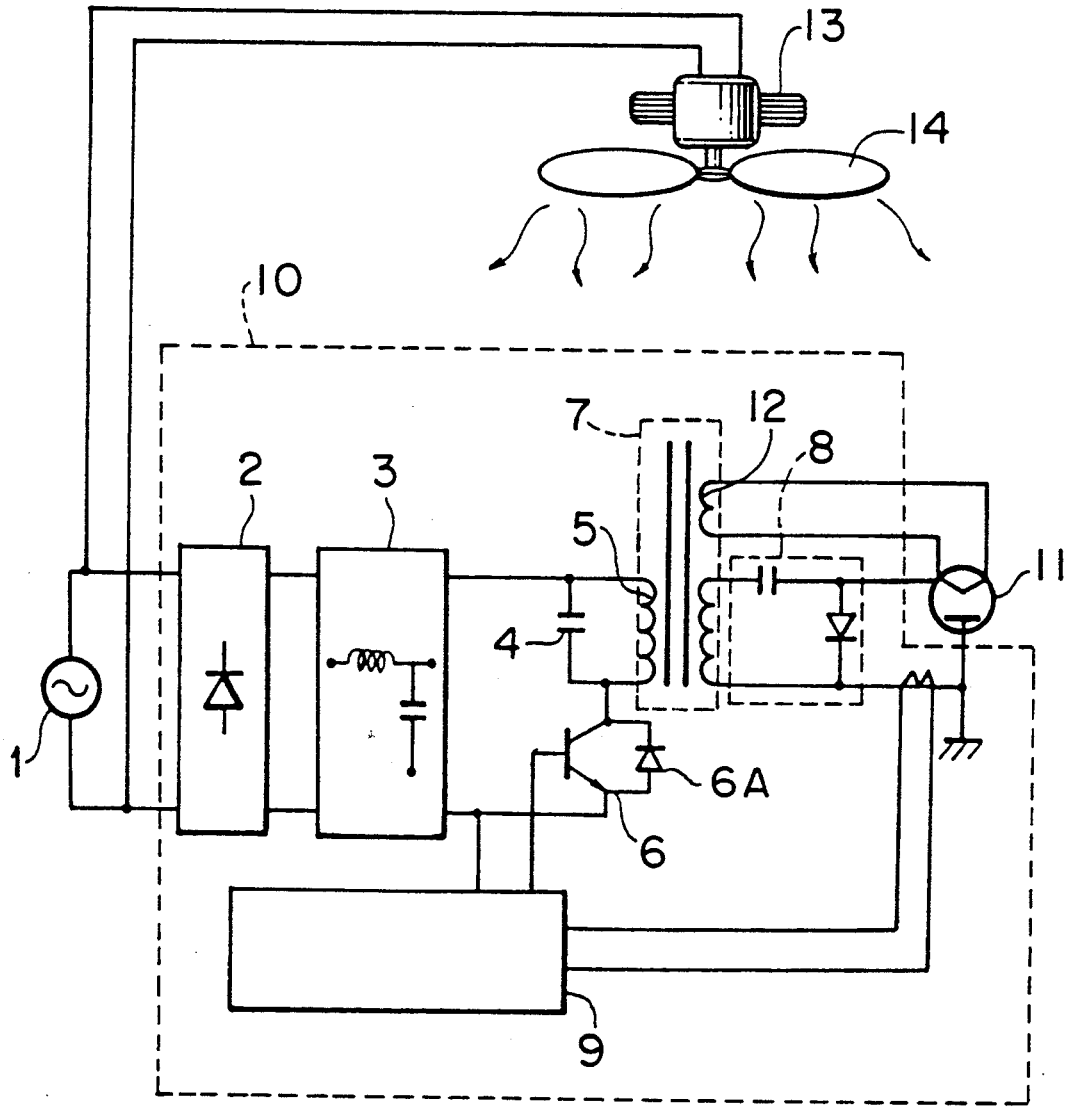
FIG. 8 RELATED ART
FIG. 8 is a circuit diagram of a power supply system of a high frequency heating apparatus according to the related art.
Figure 9:
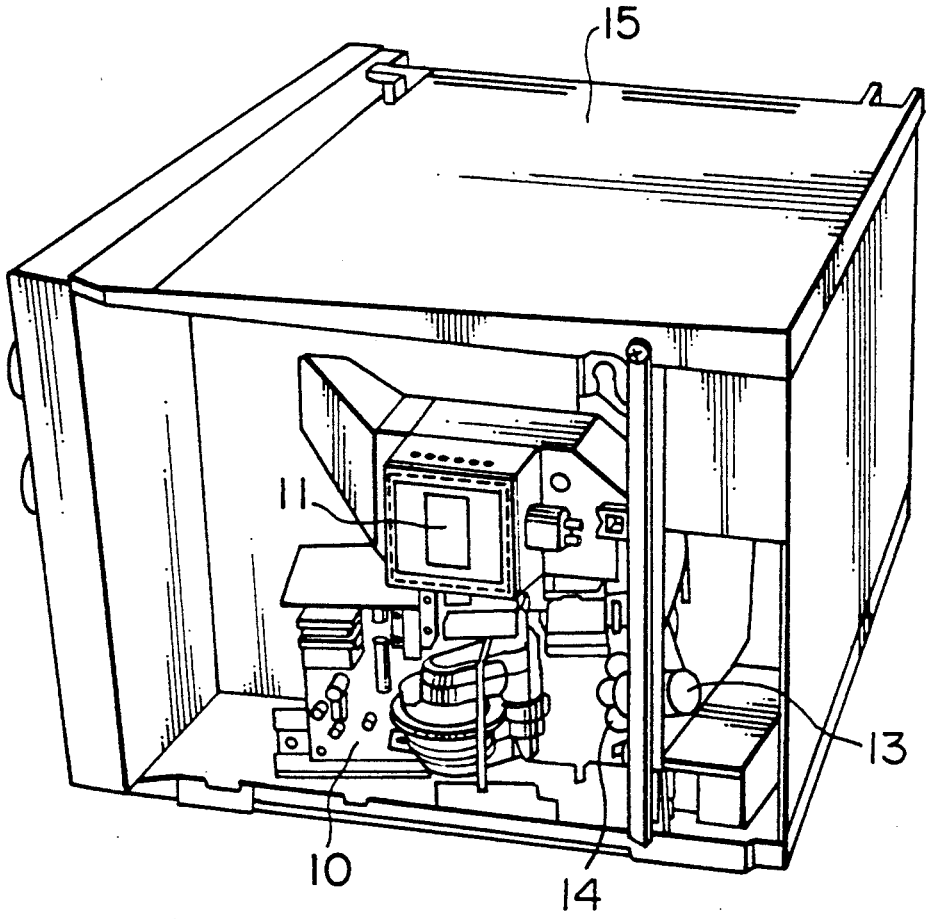
FIG. 9 RELATED ART
FIG. 9 is a perspective view of a power supply system mounted to a high frequency heating apparatus, according to the related art.

FIG. 7 illustrates the second embodiment of the present invention. A power supply system 18 similar to that in the first embodiment further comprises a first air guide 26 for guiding air into the power supply system 18 and a second air guide 27 for guiding air therefrom into a heating chamber. Both the first and second air guides 26 and 27 are removably screwed to the case 16. This construction prevents heated air from being taken in through an inlet provided on the case 16. Heated air is not only led out of the power supply system 18 but exists around the case 18 because of heat-radiation mainly from a magnetron 11. Thus, effective cooling of the power supply system 18 is ensured. Also, since the air which has received heat inside the power supply system 18 is guided through the second air guide 27 into the heating chamber, the heating efficiency of the high frequency heating apparatus is upgraded.

Since the first and second air guides 26 and 27 are formed separately from the case 16 so as to be removably mounted thereon, a plurality of the cases 16 having the same construction can be employed in differently-designed high frequency heating apparatuses simply by using suitably made first and second air guides 26 and 27. Such a feature substantially helps reduce the number of steps which are required for changing the design of an apparatus or for developing the designs for a variety of models thereof. In addition, since the first and second air guides 26 and 27 and the power supply systems 18 housed in the cases 16 can be separately manufactured and then connected on the assembly line, a large number of the power supply systems 18 housed in the cases 16 can be manufactured beforehand and stocked.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to define accorded the broadest interpretation so as to encompass all such modifications and equivalent structures and functions.

What is claimed is:

1. A high frequency heating apparatus having a heating chamber, the apparatus comprising:

a power converting unit composed of components including at least one semiconductor device for delivering an output power;

a magnetron which receives the output power from the power converting unit and supplies electromagnetic waves to the heating chamber;

a cooling fan for cooling said power converting unit and said magnetron;

a case housing therein at least said power converting unit and said magnetron, said case having an inlet opening and an outlet opening so that cooling air blown by said cooling fan is led into said case through said inlet opening and then led into the heating chamber from said case through said outlet opening in an order wherein said cooling air cools said power converting unit first and then said magnetron in that order; and waveguide means coupled between said case and the heating chamber, for guiding electromagnetic waves generated by said magnetron into the heating chamber.

2. A high frequency heating apparatus as set forth in claim 1, wherein said waveguide means comprises a waveguide wherein said case is fixed to the heating chamber by said waveguide.

3. A high frequency heating apparatus as set forth in claim 1, wherein said waveguide means and said case are removably coupled together.

4. A high frequency apparatus as set forth in claim 1, wherein said case is made of an electricity-conductive material.

5. A high frequency heating apparatus as set forth in claim 1, wherein said power converting unit comprises a transformer from which a drive power is fed to said cooling fan.

6. A high frequency heating apparatus as set forth in claim 1, wherein the cooling air blow from said cooling fan directly cools at least one semiconductor device of said power converting unit.

7. A high frequency heating apparatus as set forth in claim 6, wherein said cooling fan is incorporated in said case.

8. A high frequency heating apparatus as set forth in claim 1, wherein said components of said power converting unit are disposed on a printed circuit board and wherein said cooling fan includes a fan case which is disposed on said printed circuit board on which said components of said power converting unit are disposed.

9. A high frequency heating apparatus as set forth in claim 8, wherein said cooling fan comprises a drive motor which is disposed on said printed circuit board.

10. A high frequency heating apparatus as set forth in claim 8, wherein at least a part of said fan case serves as a cooling member to which said components of said power converting unit are attached, for cooling said components of said power converting unit.

11. A high frequency heating apparatus as set forth in claim 1, wherein a first air guide is attached to said inlet opening of said case so that the cooling air from said cooling fan is led into said case therethrough, and a second air guide from said outlet opening of said case is attached to said outlet opening of said case so that at least a part of the cooling air is led into the heating chamber therethrough.

12. A high frequency heating apparatus as set forth in claim 11, wherein said first and second air guides are removably attached to said case.

13. A high frequency heating apparatus as set forth in claim 1, further including a housing in which the heating chamber, said cooling fan and said case, containing therein said power converting unit and said magnetron, are disposed, and a buffer member, wherein said case is mounted to said housing by said buffer member.

* * * * *